United States Patent [19]

Lin et al.

[11] 4,398,059

[45] Aug. 9, 1983

[54] SPEECH PRODUCING SYSTEM

[75] Inventors: Kun-Shan Lin; Kathleen M. Goudie; Gene A. Frantz, all of Lubbock, Tex.

[73] Assignee: Texas Instruments Incorporated, Dallas, Tex.

[21] Appl. No.: 240,693

[22] Filed: Mar. 5, 1981

[51] Int. Cl.[3] ..... G10L 1/00

[52] U.S. Cl. ..... 179/1 SM

[58] Field of Search ..... 179/1 SM, 1 SF, 1 SA; 364/513, 718; 5/451

[56] References Cited

U.S. PATENT DOCUMENTS

| | | | |
|---|---|---|---|
| 3,632,887 | 1/1972 | Leipp et al. | 179/1 SA |
| 3,704,345 | 11/1972 | Coker et al. | 179/1 SA |
| 3,892,919 | 7/1975 | Ichikawa | 179/1 SM |
| 4,130,730 | 12/1978 | Ostrowski | 179/1 SM |
| 4,209,836 | 6/1980 | Wiggins et al. | 364/718 |
| 4,278,838 | 7/1981 | Antonov | 179/1 SM |
| 4,304,964 | 12/1981 | Wiggins et al. | 179/1 SM |

OTHER PUBLICATIONS

Miotti, et al., "Unlimited Vocabulary Voice . . . ," Intern. Conf. on Comm., IEEE Conf. Record, 1977.

Fallside, et al., "Speech Output from a Computer . . . ," Proc. IEEE (England), Feb. 1978, pp. 157–161.

Elovitz et al., "Letter-to-Sound Rules . . . ," IEEE Trans. on Acoustics, etc., Dec. 1976, pp. 436–455.

*Primary Examiner*—Emanuel S. Kemeny

*Attorney, Agent, or Firm*—William E. Hiller; Melvin Sharp; James T. Comfort

[57] ABSTRACT

An electronic, speech producing system receives allophonic codes and produces speech-like sounds corresponding to these codes, through a loud speaker. A micro-controller controls the retrieval, from a read-only memory, of digital signals representative of individual allophone parameters. The addresses at which such allophone parameters are located are directly related to the allophonic code. A dedicated microcontroller concatenates the digital signals representative of the allophone parameters, including code indicating stress and intonation patterns for the allophones. The allophones are divided into a plurality of frames with one digital position indicating whether the frame is the last frame in the allophone, in which event an extra frame is introduced to provide smoothing between allophones when no stop is present and when the present allophone is voiced and the subsequent allophone is voiced, or when the present allophone is unvoiced and the subsequent allophone is unvoiced. An LPC speech synthesizer receives the digital signals and provides analog signals corresponding thereto to the loud speaker to produce speech-like sounds with stress and intonation.

31 Claims, 17 Drawing Figures

Allophone code description

| Allophone | | Description |
|---|---|---|
| 1 | AE1 | as in ".A.DDITION" |
| 2 | AE1N | as in ".A.NNUITY" |
| 3 | AE2 | as in "HAT" |
| 4 | AE3 | as in "HAD" |
| 5 | AH1 | as in "DELT.A." |
| 6 | AH1N | as in ".O.N TIME" |
| 7 | AH2 | as in "HOT" |
| 8 | AH3 | as in "ODD" |
| 9 | AI2 | as in "HEIGHT" |
| 10 | AI3 | as in "HIDE" |
| 11 | AR2 | as in "CART" |
| 12 | AR3 | as in "CARD" |
| 13 | AU2 | as in "HOUSE" |
| 14 | AU3 | as in "LOUD" |
| 15 | AW1 | as in ".AU.TONOMY" |
| 16 | AW1N | as in "AN.O.NIMITY" |
| 17 | AW2 | as in "SOUGHT" |
| 18 | AW3 | as in "SAW" |
| 19 | E1 | as in ".E.LIMINATE" |
| 20 | E1N | as in ".E.NOUGH" |
| 21 | E2 | as in "HEAT" |
| 22 | E3 | as in "SEED" |
| 23 | EELL | as in "HEEL" |
| 24 | EER2 | as in "PIERCE" |
| 25 | EER3 | as in "HEAR" |
| 26 | EH1 | as in "CONT.E.XT" |
| 27 | EH1N | as in "ANCI.E.NT" |
| 28 | EH2 | as in "SET" |
| 29 | EH3 | as in "SAID" |
| 30 | EHR2 | as in "TH.ER.APY" |
| 31 | EHR3 | as in "THERE" |
| 32 | EI2 | as in "TAKE" |
| 33 | EI3 | as in "DAY" |
| 34 | ER1 | as in "SEEK.ER" |
| 35 | ER1N | as in "WEST.ER.N" |
| 36 | ER2 | as in "HURT" |
| 37 | ER3 | as in "HEARD" |
| 38 | I1 | as in "SYNTH.E.S.I.S" |
| 39 | I1N | as in ".I.NANE" |

Fig. 2a

| | | |
|---|---|---|
| 40 | I2 | as in ".I.SSUE" |
| 41 | I3 | as in "HID" |
| 42 | ILL | as in "HILL" |
| 43 | ING2 | as in "THINK" |
| 44 | O1 | as in "RATI.O." |
| 45 | O1N | as in "D.O.NATION" |
| 46 | OI2 | as in "CHOICE" |
| 47 | OI3 | as in "BOY" |
| 48 | OO1 | as in "T.OO.K ON" |
| 49 | OO2 | as in "COOK" |
| 50 | OO3 | as in "COULD" |
| 51 | OOR2 | as in "POORLY" |
| 52 | OOR3 | as in "POOR" |
| 53 | OR2 | as in "HORSE" |
| 54 | OR3 | as in "CORE" |
| 55 | OW2 | as in "BOAT" |
| 56 | OW3 | as in "LOW" |
| 57 | U1 | as in "ANN.U.AL" |
| 58 | U1N | as in ".U.NIQUE" |
| 59 | U2 | as in "SHOOT" |
| 60 | U3 | as in "SHOE" |
| 61 | UH1 | as in ".A.BOVE" |
| 62 | UH1M | as in "INSTR.U.MENTS" |
| 63 | UH1N | as in ".U.NERNEATH" |
| 64 | UH2 | as in "HUT" |
| 65 | ULL | as in "SK.U LL." |
| 66 | UHL | as in "P.ULL." |
| 67 | UH3 | as in "MUD" |
| 68 | UU2 | as in "BOOT" |
| 69 | UU3 | as in "MOON" |
| 70 | Y1 | as in "ROS.E.S" |
| 71 | Y1N | as in "BASEM.E.NT" |
| 72 | Y2 | as in "FUNN.Y." |
| 73 | LL | as in "AWF.UL.","WE.LL." |
| 74 | B | as in "BAD" |
| 75 | BB | as in "DAB" |
| 76 | D | as in "DIG" |
| 77 | DD | as in "BID" |
| 78 | G1 | as in "GIVE" |
| 79 | G2 | as in "GO" |
| 80 | GG | as in "BAG" |
| 81 | K2 | as in "SKATE" |
| 82 | KH | as in "CASE" |
| 83 | KH- | as in "MAKE" |
| 84 | KH1 | as in "KEY" |
| 85 | KH2 | as in "COUGH" |
| 86 | P | as in "SPACE" |
| 87 | PH | as in "PIE" |
| 88 | PH- | as in "NAP" |
| 89 | T | as in "STAKE" |
| 90 | TH | as in "TIE" |
| 91 | TH- | as in "LATE" |
| 92 | CH | as in "CHURCH" |
| 93 | F | as in "FAT" |
| 94 | FF | as in "LAUGH" |

Fig. 2b

| | | |
|---|---|---|
| 95 | HI | as in "HIT" |
| 96 | HO | as in "HOME" |
| 97 | HUH | as in "HUT" |
| 98 | J | as in "JUG" |
| 99 | JJ | as in "BUDGE" |
| 100 | L | as in "LIKE" |
| 101 | L- | as in "BOWL" |
| 102 | M | as in "MAY" |
| 103 | MM | as in "HUM" |
| 104 | N | as in "NICE" |
| 105 | NN | as in "SANE" |
| 106 | NG1 | as in "THINK" |
| 107 | NG2 | as in "THING" |
| 108 | R | as in "REAL" |
| 109 | S | as in "SEEM" |
| 110 | SS | as in "MISS" |
| 111 | SH | as in "SHINE" |
| 112 | SH- | as in "WASH" |
| 113 | THF | as in "THING" |
| 114 | THF- | as in "WITH" |
| 115 | THV | as in "THIS" |
| 116 | THV- | as in "CLOTHE" |
| 117 | V | as in "VINE" |
| 118 | VV | as in "LIVE" |
| 119 | W | as in "WITCH" |
| 120 | WH | as in "WHICH" |
| 121 | Y | as in "YOU" |
| 122 | Z | as in "ZOO" |
| 123 | ZZ | as in "DOES" |
| 124 | ZH | as in "AZURE" |
| 125 | ZH- | as in "BEIGE" |
| 126 | Pause | (short pause) |
| 127 | Pause | (long pause) |

*Fig. 2c*

JOINS FIG. 6f
52
36
40
PRIMARY LAST VOWEL
NO
Q OR S ?
S
4
FIRST FRAME
YES
NO
Pi = Pi−1 +1 IF Pi ≤BP+2
OTHERWISE Pi = BP+2
Pi = Pi−1+2
Pi = Pi−1
Q
Q OR S ?
S
Pi = Pi−1−1 IF Pi ≥BP−D
OTHERWISE, Pi = BP−D
Pi = Pi−1+1 IF Pi ≤BP+D,
OTHERWISE, Pi = BP+D
SEND E, Pi, Ki, K2−K10
TO 286
3

37
40
LAST VOWEL ?
YES
NO
QUESTION OR STATEMENT ?
Q
S
FIRST FRAME ?
NO
YES
Pi = Pi-1-1 IF Pi ≥ BP-D OTHERWISE Pi = BP-D
Pi = BP+D-2
Pi = BP-D+2
Pi = Pi-1+1 IF Pi ≤ BP+D OTHERWISE Pi = BP+D
QUESTION OR STATEMENT ?
Q
S
FIRST FRAME ?
YES
NO
Pi = BP+D-2 PV = Pi
Pi = BP-D+2 BP = BP+D-2 PZ = BP-D # OF SECONDARY = 1
Pi = Pi-1
JOINS FIG. 6d
JOINS FIG. 6i

JOINS FIG. 6h
40
OF SECONDARY = 1 ?
43
YES
NO
Pi = P2
FIRST FRAME
Pi = Pi-1
YES
P2 = P2 + 2 IF P2 ≤ BP; PZ = BP
Pi = P2
P2 = P2
FIRST FRAME ?
44
YES
NO
PV = PV-2 IF PV ≥ BP-D OTHERWISE PV = BP-D
Pi = PV+1
Pi = Pi-1
39
45
Pi = Pi-1 IF Pi ≥ BP-D; OTHERWISE Pi = BP-D
46
Pi = Pi-1+1 IF Pi ≤ BP+2; OTHERWISE Pi = BP+2
47
PV = PV-2 IF PV ≥ BP-D; OTHERWISE. PV = BP-D
48
Pi = PV
49
50
51
JOINS FIG. 6e

SPEECH PRODUCING SYSTEM

BACKGROUND OF THE INVENTION

1. Field of the Invention

This invention pertains to electronic speech producing systems and more particularly to systems that receive parameter encoding information such as allophonic code, which is decoded, stressed and synthesized in an LPC speech synthesizer to provide unlimited vocabulary.

2. Description of the Prior Art

Waveforming encoding and parameter encoding generally categorize the prior art techniques. Waveform encoding includes uncompressed digital data-pulse code modulation (PCM), delta modulation (DM), continuous variable slope delta modulation (CVSD) and a technique developed by Mozer (see U.S. Pat. No. 4,214,125). Parameter encoding includes channel vocoder, Formant synthesis, and linear predictive coding (LPC).

PCM involves converting a speech signal into digital information using an A/D converter. Digital information is stored in memory and played back through a D/A converter through a low-pass filter, amplifier and speaker. The advantages of this approach is its simplicity. Both A/D converters and D/A converters are available and relatively inexpensive. The problem involved is the amount of data storage required. Assuming a maximum frequency of 4K Hz, and further assuming each speech sample being represented by 8 to 12 bits, one second of speech requires 64K to 96K bits of memory.

DM is a technique for compressing the speech data by assuming that the analog-speech signal is either increasing or decreasing in amplitude. The speech signal is sampled at a rate of approximately 64,000 times per second. Each sample is then compared to the estimated value of the previous sample. If the first value is greater than the estimated value of the latter, then the slope of the signal generated by the model is positive. If not, the slope is then negative. The magnitude of the slope is chosen such that it is at least as large as the maximum expected slope of the signal.

CVSD is a technique that is an extension of DM which is accomplished by allowing the slope of the generated signal to vary. The data rate in DM is typically in the order of 64K bits per second and in CVSD it is approximately 16K–32K bits per second.

The Mozer technique takes advantage of the periodicity of voiced speech waveform and the perceptual insensitivity to the phase information of the speech signal. Compressing the information in the speech waveform requires phase-angle adjustment to obtain a time-symmetrical pitch waveform which makes one-half of the waveform redundant; half period zeroing to eliminate relatively low-power segments of the waveform; digital compression using DM and repetition of pitch periods to eliminate redundant (or similar) speech segments. The data rate of this technique is approximately 2.4K bits per second.

In parameter encoding schemes, speech characteristics other than the original speech waveform are used in the analysis and synthesis. These characteristics are used to control the synthesis model to create an output speech signal which is similar to the original. The commonly used techniques attempt to describe the spectral response, the spectral peaks or the vocal tract.

The channel vocoder has a bank of band-pass filters which are designed so that the frequency range of the speech signal can be divided into relatively narrow frequency ranges. After the signal has been divided into the narrow bands the energy is detected and stored for each band. The production of the speech signal is accomplished by a bank of narrow band frequency generators, which correspond to the frequencies of the band-pass filters, controlled by pitch information extracted from the original speech signal. The signal amplitude of each of the frequency generators is determined by the energy of the original speech signal detected during the analysis. The data rate of the channel vocoder is typically in the order of 2.4K bits per second.

In formant synthesis, the short time frequency spectrum is analyzed to the extent that the spectral shape is recreated using the formant center frequencies, their band-widths and the pitch period as the inputs. The formants are the peaks in a frequency spectrum envelope. The data rate for formant synthesis is typically 500 bits per second.

Linear predictive coding (LPC) can best be described as a mathematical model of the human vocal tract. The parameters used to control the model represent the amount of energy delivered by the lungs (amplitude), the vibration of the vocal cords (pitch period and the voiced/unvoiced decision), and the shape of the vocal tract (reflection coefficients). In the prior art, LPC synthesis has been accomplished through computer simulation techniques. More recently, LPC synthesizers have been fabricated in a semiconductor, integrated circuit chip such as that described and claimed in U.S. Pat. No. 4,209,836 entitled "Speech Synthesis Integrated Circuit Device" and assigned to the assignee of this invention.

This invention is a combination of a speech construction technique and a speech synthesis technique. The prior art set out above involves synthesis techniques.

With respect to speech construction techniques, the library of available component sounds includes phonemes, allophones, diphones, demisyllables, morphs and combinations of these sounds.

Speech construction techniques involving phonemes are flexible techniques in the prior art. In English, there are 16 vowel phonemes and 24 consonant phonemes making a total of 40. Theoretically, any word or phrase desired should be capable of being constructed from these phonemes. However, when each phoneme is actually pronounced there are many minor variations that may occur between sounds, which may in turn modify the pronunciation of the phoneme. This inaccuracy in representing sounds causes difficulty in understanding the resulting speech produced by the synthesis device.

Another prior art construction technique involves the use of diphones. A diphone is defined as the sound that extends from the middle of one phoneme to the middle of the next phoneme. It is chosen as a component sound to reduce smoothing requirements between adjacent phonemes. However, to encompass any of the coarticulation effects in English, a large inventory of diphones is usually required. The storage requirement is in the order of 250K bytes, with a computer required to handle the construction program.

Demisyllables have been used in the prior art as component sounds for speech construction. A syllable in any language may be divided into an initial demisyllable, final demisyllable and possible phonetic affixes. The initial demisyllable consists of any initial consonants and the transition into the vowel. The final demisyllable consists of the vowel and any co-final consonants. The phonetic affixes consist of all syllable-final non-core consonants. The prior art system requires a library of 841 initial and final demisyllables and 5 phonetic affixes. The memory requirement is in the order of 50K bytes.

A morph is the smallest unit of sound that has a meaning. In a prior art system, for unrestricted English text, a dictionary of 12,000 morphs was used which required approximately 600K bytes of memory. The speech generated is intelligible and quite natural but the memory requirement is prohibitive.

An allophone is a subset of a phoneme, which is modified by the environment in which it occurs. For example, the aspirated /p/ in "push" and the unaspirated /p/ in "Spain" are different allophones of the phoneme /p/. Thus, allophones are more accurate in representing sounds than phonemes. According to the present invention, 127 allophones are stored in 3,000 bytes of memory. The storage requirement is much less than the aforementioned system using diphones, demisyllables and morphs.

BRIEF SUMMARY OF THE INVENTION

In the preferred embodiment, allophonic code is presented to a speech producing system which synthesizes sound through the use of a digital, semiconductor LPC synthesizer. It is to be understood, however, that other sound components such as the aforementioned phonemes, diphones, demisyllables and morphs in coded forms are also contemplated for use with this LPC synthesizer. Furthermore, the allophonic code in this preferred embodiment is contemplated for use in other digital synthesizers as well as the LPC synthesizer of this preferred embodiment.

An allophone library is stored in a ROM. A microprocessor receives the allophonic code and addresses the ROM at the address corresponding to the particular allophonic code entered. An allophone, represented by its speech parameters, is retrieved from the ROM, followed by other allophones forming the words and phrases. A dedicated micro-controller is used for concatenating (stringing) the allophones to form the words and phrases. When stringing allophones, an interpolation frame of 25 ms is created between allophones to smooth out sound transitions in LPC parameters. However, no interpolation is required when the voicing transition occurs. Energy is another parameter that must be smoothed. To obtain an overall smooth energy contour for the strung phrases, interpolation frames are usually created at both ends of the string with energy tapered toward zero. The smoothing technique described subsequently herein reduces the abrupt changes in sound which are usually perceived as pops, squeaks, squeals, etc.

Stress and intonation greatly contribute to the perceptual naturalness and contextual meaning of constructive speech. Stress means the emphasis of a certain syllable within a word, whereas intonation applies to the overall up-and-down patterns of pitch within a multisyllable word, phrase or sentence. The contextual meaning of a sentence may be changed completely by assigning stress and intonation differently. Therefore, English does not sound natural if it is randomly intoned. The stress and intonation patterns which are a part of the speech construction technique herein contribute to the understandability and naturalness of the resulting speech. Stress and intonation are based on gradient pitch control of the stressed syllables preceding the primary stress of the phrase. All the secondary stress syllables of the sentence are thought of as lying along a line of pitch values tangent to the line of the pitch values of the unstressed syllables. The unstressed syllables lie on a mid-level of pitch, with the stress syllables lying on a downward slanted tangent to produce an overall down drift sensation. The user is required to mark stressed syllables in the allophonic code. The stressed syllables then become the anchor point of the pitch patterns. A microprocessor automatically assigns the appropriate pitch values to the allophones which have been strung.

At this point, there exists an inventory of LPC parameters which have been strung together and designated in pitch as set out above. The LPC parameters are then sent to the speech synthesis device, which in this preferred embodiment is the device described in U.S. Pat. No. 4,209,836 mentioned earlier and which is incorporated herein by reference. The smoothing mentioned above is accomplished by circuitry on the synthesizer chip. The smoothing could also be accomplished through the microprocessor.

The principal object of this invention is to provide a voice response system that has an unlimited vocabulary in any language.

It is another object of this invention to provide an economic mechanism for producing speech-like sounds that are good in quality, with an unlimited vocabulary.

Another object of this invention is to provide a speech system which is low cost in terms of storage and yet provides understandable synthesized speech.

Still another object of this invention is to provide a speech system which employs a digital, semiconductor integrated circuit LPC synthesizer in combination with concatenated sound input to provide an unlimited vocabulary.

A further object of this invention is to provide a stress and intonation pattern to the input code so that the pitch is adjusted automatically according to a natural sounding intonation pattern at the output.

An all encompassing object of this invention is to provide a highly flexible, low cost synthetic speech system with the advantages of unlimited vocabulary and good speech quality.

These and other objects will be made evident in the detailed description that follows.

BRIEF DESCRIPTION OF THE DRAWINGS

FIGS. 2*a*–2*c* are a description of the allophone library.

DETAILED DESCRIPTION OF THE INVENTION

Figure 1:
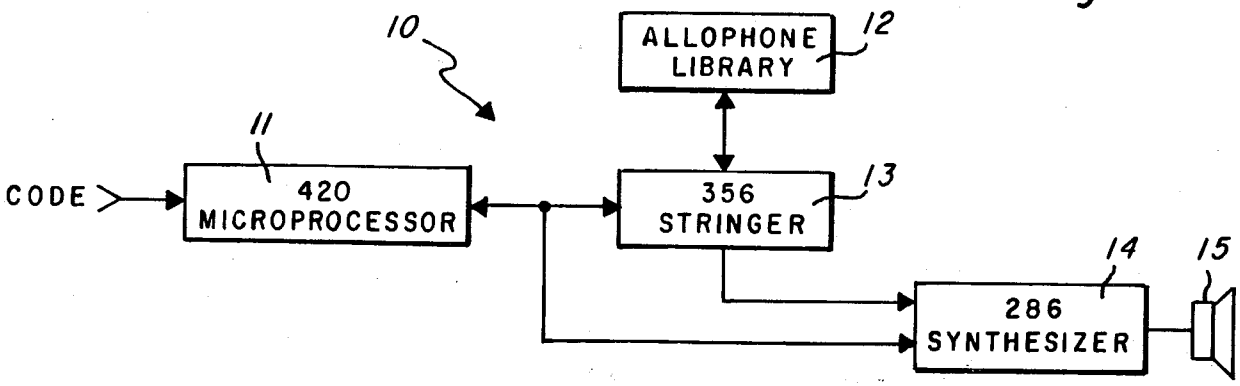
FIG. 1 is a block diagram of the inventive speech producing system.

FIG. 1 illustrates the speech producing system 10 having an allophonic code input to microprocessor 11 which is connected to control the stringer controller 13 and the synthesizer 14. Allophone library 12 is accessed through the stringer controller 13. The output of synthesizer 14 is through speaker 15 which produces speech-like sounds in response to the input allophonic code.

The 420 microprocessor 11 is a Texas Instruments Incorporated Type TMCO420 microcomputer which includes 26 sheets of specification and 9 sheets of drawings, enclosed herewith and incorporated by reference.

The 356 stringer controller 13 is a Texas Instruments TMCO356, which comprises 21 specification sheets, and 11 sheets of drawings, enclosed herewith and incorporated by reference.

Allophone library 12 is a Texas Instruments Type TMS6100 (TMC350) voice synthesis memory which is a ROM internally organized as 16K×8 bits.

Synthesizer 14 is fully described in previously mentioned U.S. Pat. No. 4,209,836. However, in addition, 286 synthesizer 14 has the facility for selectively smoothing between allophones and has circuitry for providing a selection of speech rate which is not part of this invention.

FIGS. 2*a* through 2*c* illustrate the allophones within the allophone library 12. For example, allophone 18 is coded within ROM 12 as "AW3" which is pronounced as the "a" in the word "saw." Allophone 80 is set in the ROM 12 as code corresponding to allophone "GG" which is pronounced as the "g" in the word "bag." Pronunciation is given for all of the allophones stored in the allophone library 12.

Figure 3:
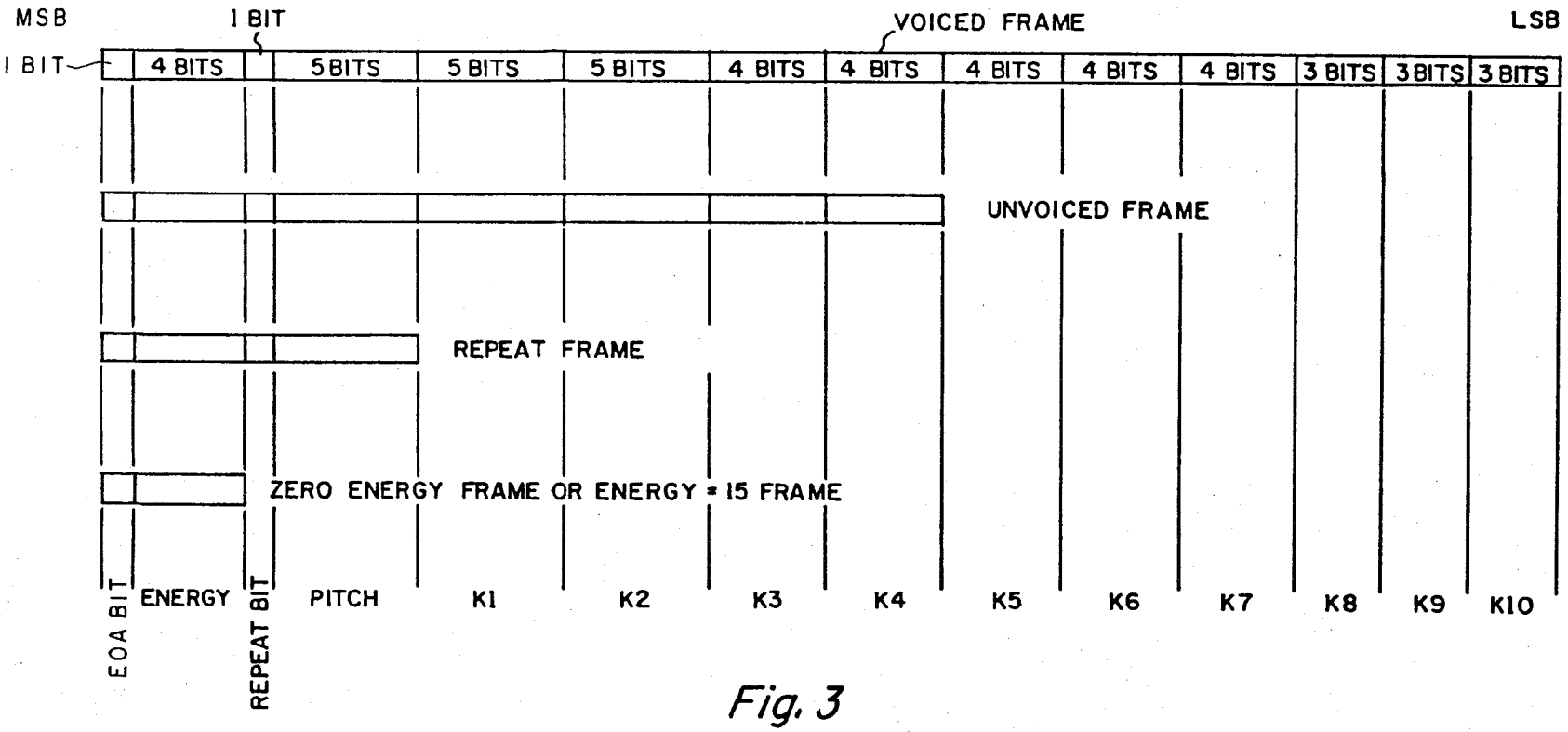
FIG. 3 illustrates the synthesizer frame bit content.

Each allophone is made up of as many as 10 frames, the frames varying from four bits for a zero energy frame, to ten bits for a "repeat frame" to 28 bits for a "unvoiced frame" to 49 bits for a "voiced frame." FIG. 3 illustrates this frame structure. A detailed description is present in previously mentioned U.S. Pat. No. 4,209,836.

In this preferred embodiment, the number of frames in a given allophone is determined by a well-known LPC analysis of a speaker's voice. That is, the analysis provides the breakdown of the frames required, the energy for each frame, and the reflection coefficients for each frame. This information is stored then to represent the allophone sounds set out in FIGS. 2*a*–2*c*.

Smoothing between certain allophones is accomplished by circuitry illustrated in FIGS. 7*a* and 7*a* (cont'd) of U.S. Pat. No. 4,209,836. In FIGS. 7*a* and 7*a* (cont'd), signal $\overline{\text{SLOW D}}$ is applied to parameter counter 513, which causes a frame width of 25 MS to be slowed to 50 MS. Interpolation (smoothing) is performed by the circuitry shown in FIGS. 9*a*, 9*a* (cont'd), 9*b*, 9*b* (cont'd) over a 50 MS period when signal $\overline{\text{SLOW D}}$ is present and over a 25 MS period when signal $\overline{\text{SLOW D}}$ is absent. In the invention of U.S. Pat. No. 4,209,836, a switch was set to cause slow speech through signal $\overline{\text{SLOW D}}$. All frames were lengthened in duration.

In the present invention, $\overline{\text{SLOW D}}$ is present only when the last frame in an allophone is indicated by a single bit in the frame. The actual interpolation (smoothing) circuitry and its operation are described in detail in U.S. Pat. No. 4,209,836.

FIG. 3 illustrates the bit formation of the allophone frame received by the 286 synthesizer 14. As shown, MSB is the end of allophone (EOA) bit. When EOA=1, it is the last frame in the allophone. When EOA=0, it is not the last frame in the allophone. FIG. 3 illustrates a total of 50 bits (including EOA) for the voiced frame, 29 bits for the unvoiced frame, 11 bits for the repeat frame and 5 bits for the zero energy frame or the energy equals 15 frame.

Figure 4:
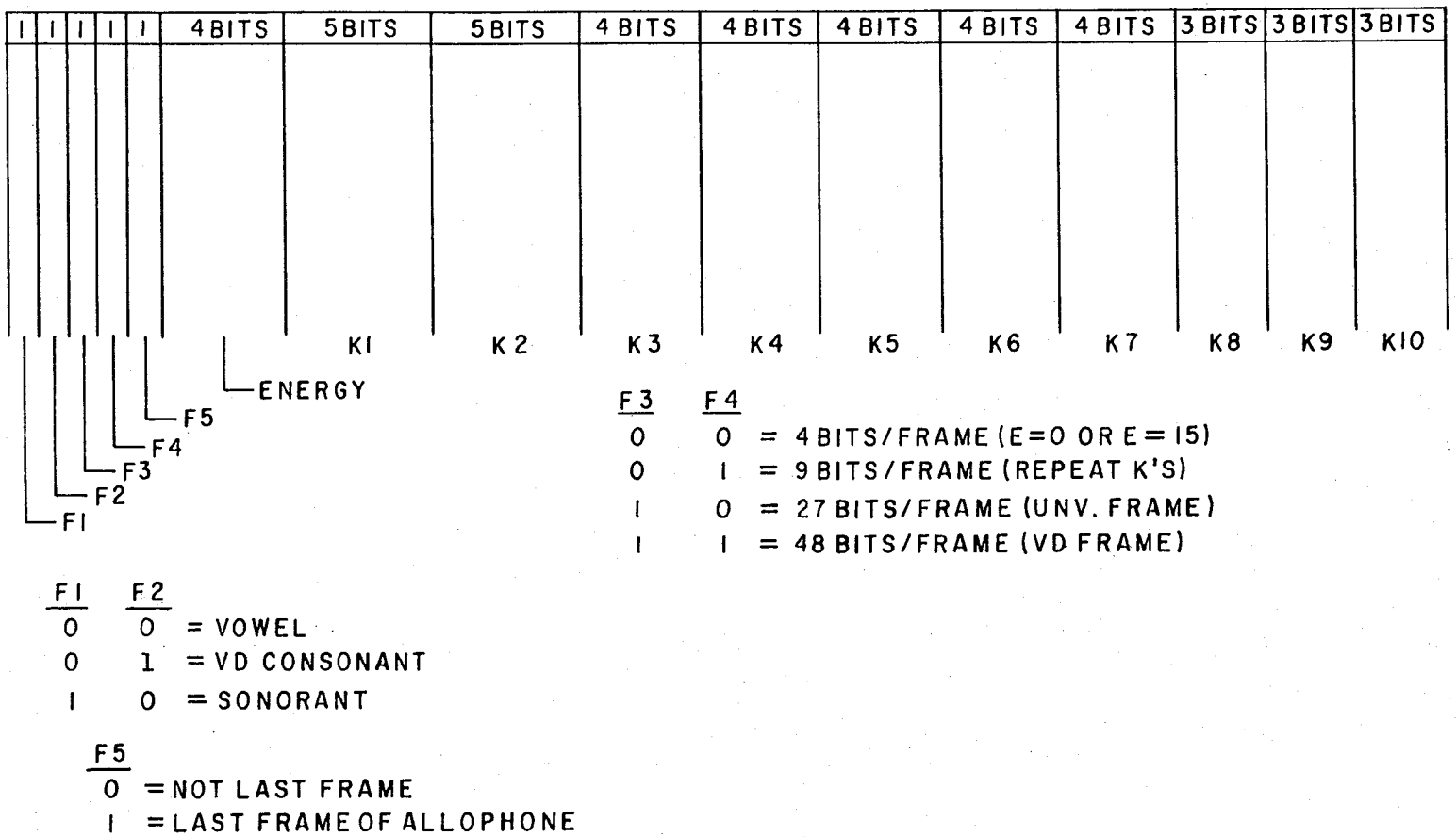
FIG. 4 illustrates the allophone library bit content.

FIG. 4 illustrates an allophone frame from the allophone library 12. F1–F5 are each one bit flags with F5 being the EOA bit which is transferred to the 286 synthesizer 14. The combination of flags F1 and F2 and the combination of flags F3 and F4 are shown in FIG. 4 and the meaning of those combinations set out.

Figure 5A:
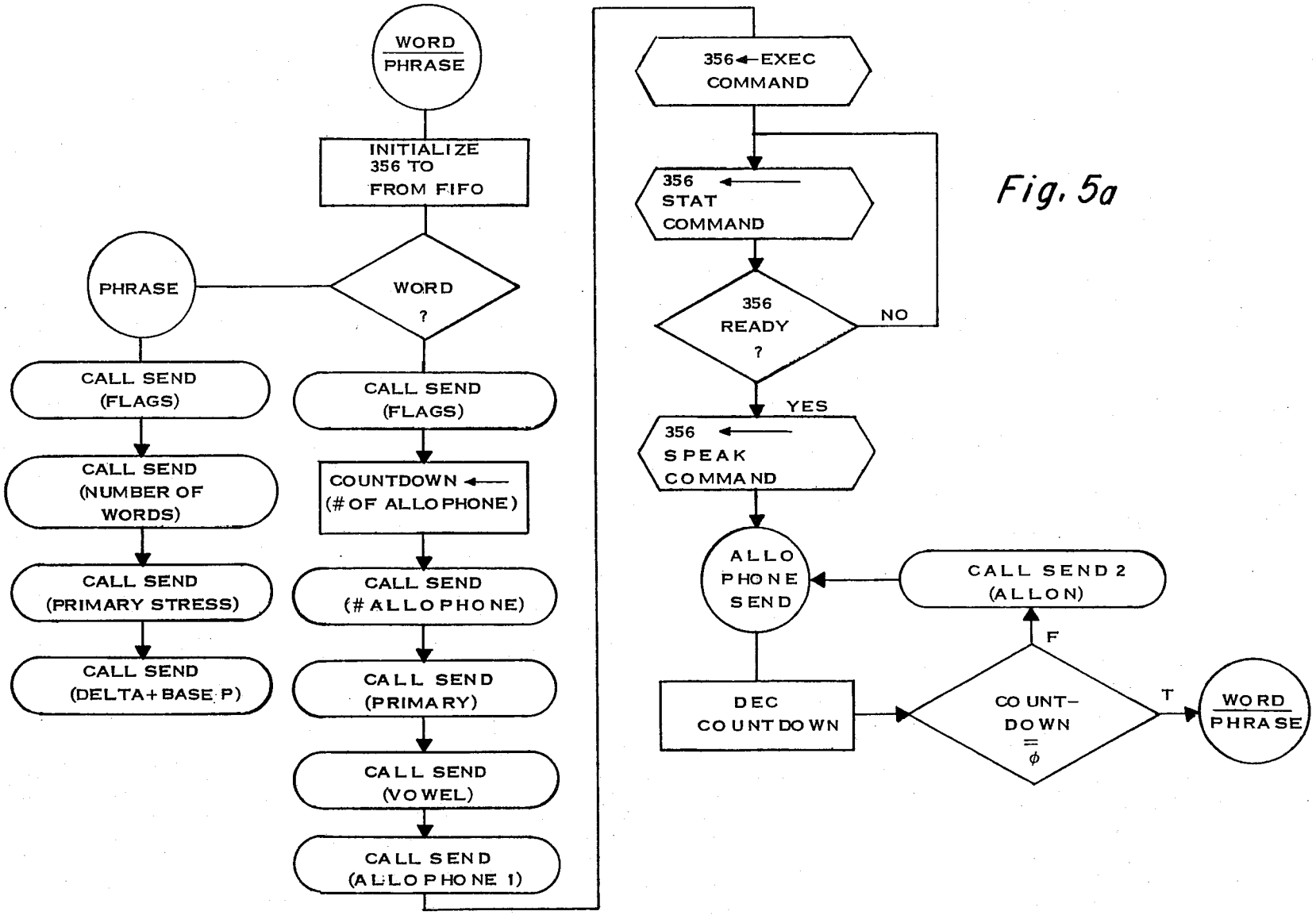
FIGS. 5*a* and 5*b* form a flowchart describing the operation of the microprocessor of the system.
Figure 5B:
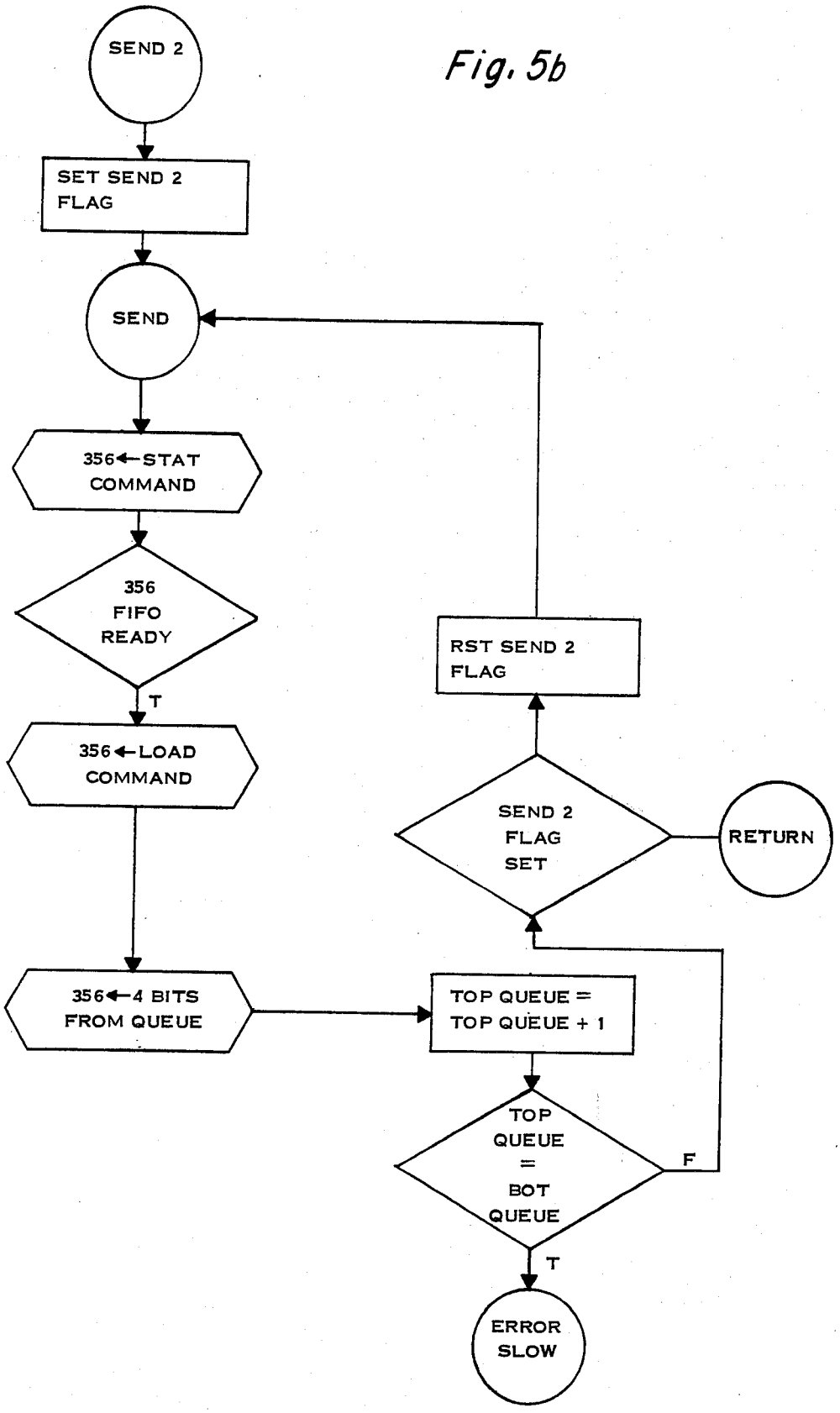

FIGS. 5*a* and 5*b* form a flowchart illustrating the details of control exerted by the 420 microprocessor 11 over, primarily, the 356 stringer 13. Beginning at "word/phrase," the first-in, first-out (FIFO) register of the 356 stringer 13 is initialized to receive the allophonic code from 420 microprocessor 11. Next it is determined whether the incoming information is simply a word or a phrase. If it is simply a word, then the call routine is brought up to send flag information representative of allophones, the primary stress and which vowel is the last in the word. The number of allophones is set in a countdown register and the number of allophones is sent to the 356 stringer 13.

The primary stress to be given is sent, followed by the information as to which vowel is the last one in the word. Finally, a send 2 is called to send the entire 8 bits (7 bits allophone, 1 bit stress flag). It should be noted that the previous send routine involved sending only 4 bits.

A send 2 flag is set and a status command is sent to the 356 stringer 13. Then, if the 356 FIFO is ready to receive information, the FIFO is loaded.

Four bits are then sent from the 420 microprocessor 11 queue register to the FIFO of the 356 stringer 13. The queue is incremented and checked to determine whether it has been emptied. If it has been emptied, there is an error. If it has not been emptied, then the send 2 flag is interrogated. If it is not set, then the routine returns to the send 2 call mentioned above. If the flag is set, then it is cleared and the next four bits are brought in to go through the same routine as indicated above.

When the return is made, an execute command is sent to the 356 stringer 13 after which a status command is sent. If the 356 stringer 13 is ready, a speak command is given. If it is not ready, the status command is again sent until the stringer 13 is ready. Then the allophone is sent and the countdown register containing the number of allophones is decremented. If the countdown equals zero, the routine is again started at word/phrase. If the countdown is not equal to zero, then the send 2 routine is again called and the next allophone is brought with the procedure being repeated until the entire word has been completed.

If a phrase had been sent rather than a word, then and similar to the case of the single word, status flags are sent, and the call routine is sent, indicating first the number of words, then the primary stress, and then the base pitch and the delta pitch. At that point, the routine returns to word/phrase and is identical to that set out above.

FIGS. 6*a*–6*i* form a flowchart of the details of the control of the action of the 356 stringer 13 on the allophones. Beginning in FIG. 6*a*, the starting point is to "read an allophone address" and then to "read a frame of allophone speech data." On path 31 to FIG. 6*b*, a decision block inquiring "first frame of the allophone" is reached. If the answer is "yes," then it is necessary to decode the flags F1–F5. If the answer is "no," then it is necessary to only decode flags F3, F4 and F5. As indicated above, flags F1 and F2 determine the nature of the allophone and need not be further decoded. After the decoding, in either case, a decision block is reached where it is necessary to determine whether F3 F4=00. If the answer is "yes" then the energy is 0 and a decision is made as to whether F5=1, indicating the last frame in the allophone. If the answer is yes, then the decision is reached as to whether it is the last allophone. If the answer is "yes," the routine has ended. If F5 is not equal to 1, then E=0 is sent to the 286 synthesizer 14 and the next frame is brought in as indicated on FIG. 6*a*. If F5=1, and it is not the last allophone, then the information E =0 and F5=1 is sent to the 286 synthesizer 14 and the next allophone is called starting at the beginning of the routine.

If F3 and F4 is not equal to 00, then it is determined whether F3 F4=01, indicating a 9 bit word because a repeat, using the same K parameters, is to follow. If the answer is "no," then on path 32 to FIG. 6*c*, it is determined whether F3 F4=10, indicating 27 bits for an unvoiced frame. If the answer is "yes," the first four bits are read as energy. Five bits for pitch are created as 0 and the next four bits are read as K1–K4. Then energy and pitch=0 and K1–K4 are sent to the 286 synthesizer 14. If F3 F4≠10, then F3 F4=11 indicating a voiced 48 bit frame and the first four bits are read as energy, the next five bits are created as pitch and the ten K parameters are read.

Figure 6A:
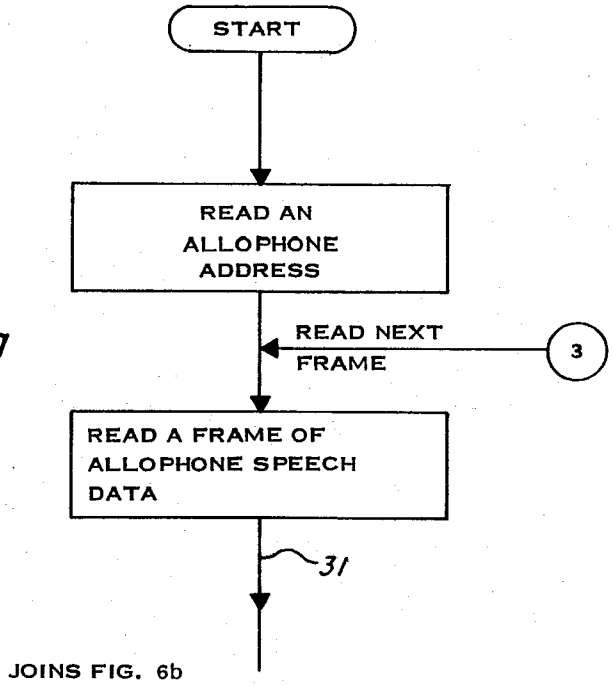
FIGS. 6*a*–6*i* form a flowchart describing the intonation pattern structuring.
Figure 6B:
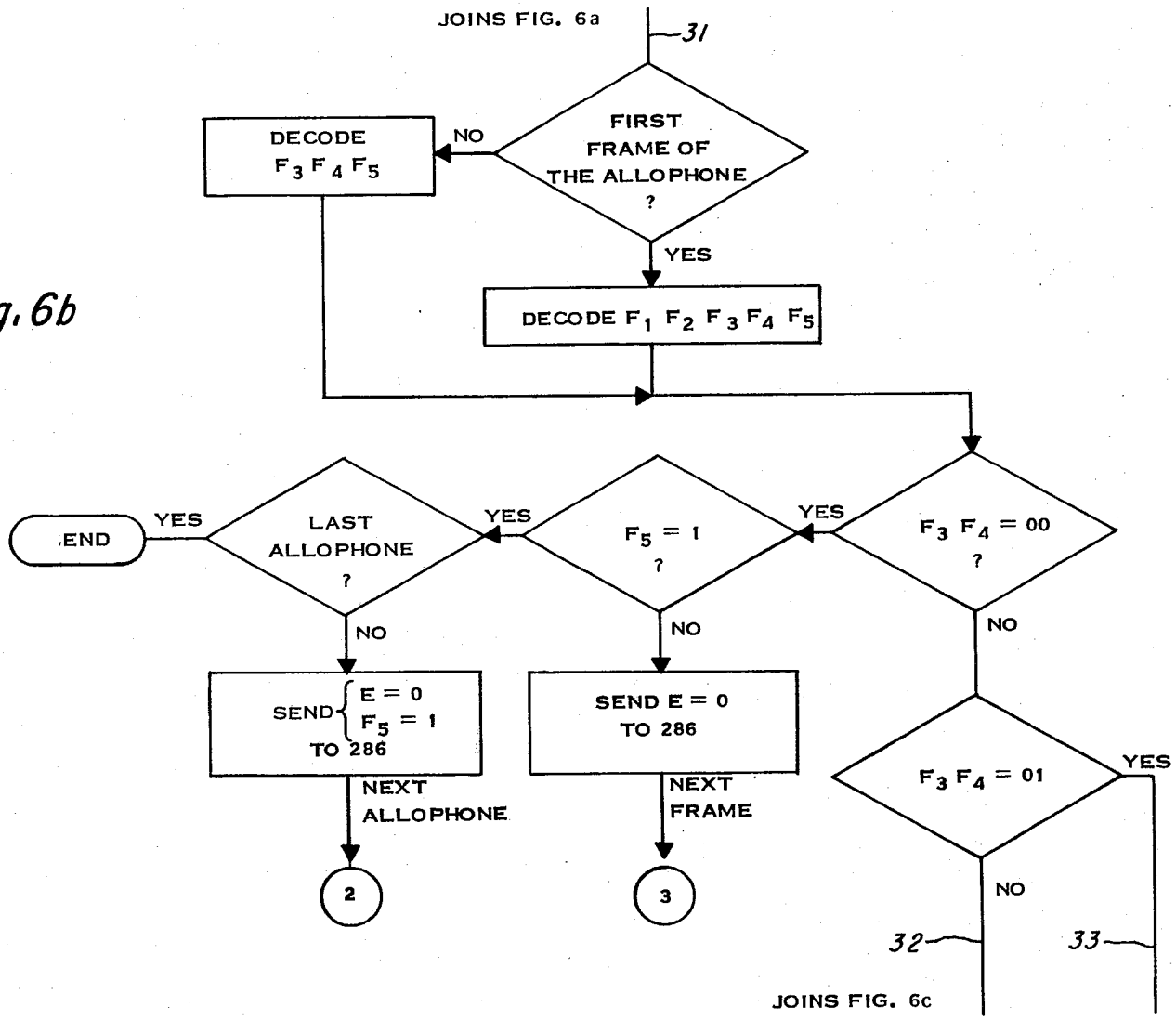
Figure 6C:
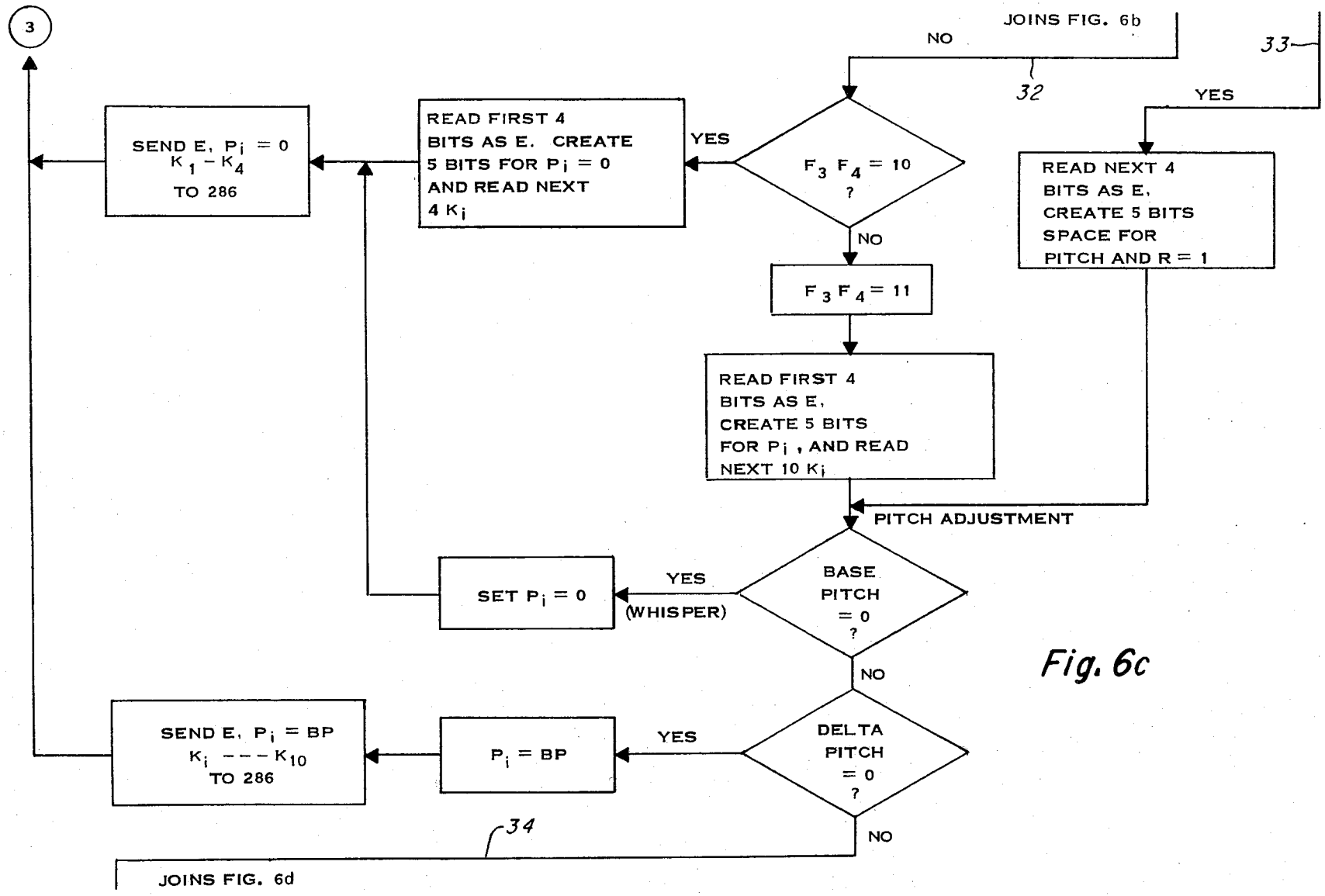

Turning to FIG. 6*b*, if it was determined that F3 F4=01, then on path 33 into FIG. 6*c*, the next four bits are read as energy, a five bit space is created for pitch and repeat (R)=1. At this point, if F3 F4=11 or if F3 F4=01, a pitch adjustment is to be made. The inquiry "base pitch=0?" is made. If the answer is "yes," then the speech is a whisper and pitch is set to 0. At that point, energy and pitch=0 and K1 to K4 are sent to the 286 synthesizer 14. The next frame is brought in as indicated on FIG. 6*a*.

If the base pitch≠0, then a decision is made as to whether the delta pitch=0. If the answer is "yes," then the pitch is made equal to the base pitch. The energy, and pitch equal to the monotone base pitch, and the parameters K1–K10 are sent to the 286 synthesizer 14 and the next frame is brought in.

Figure 6D:
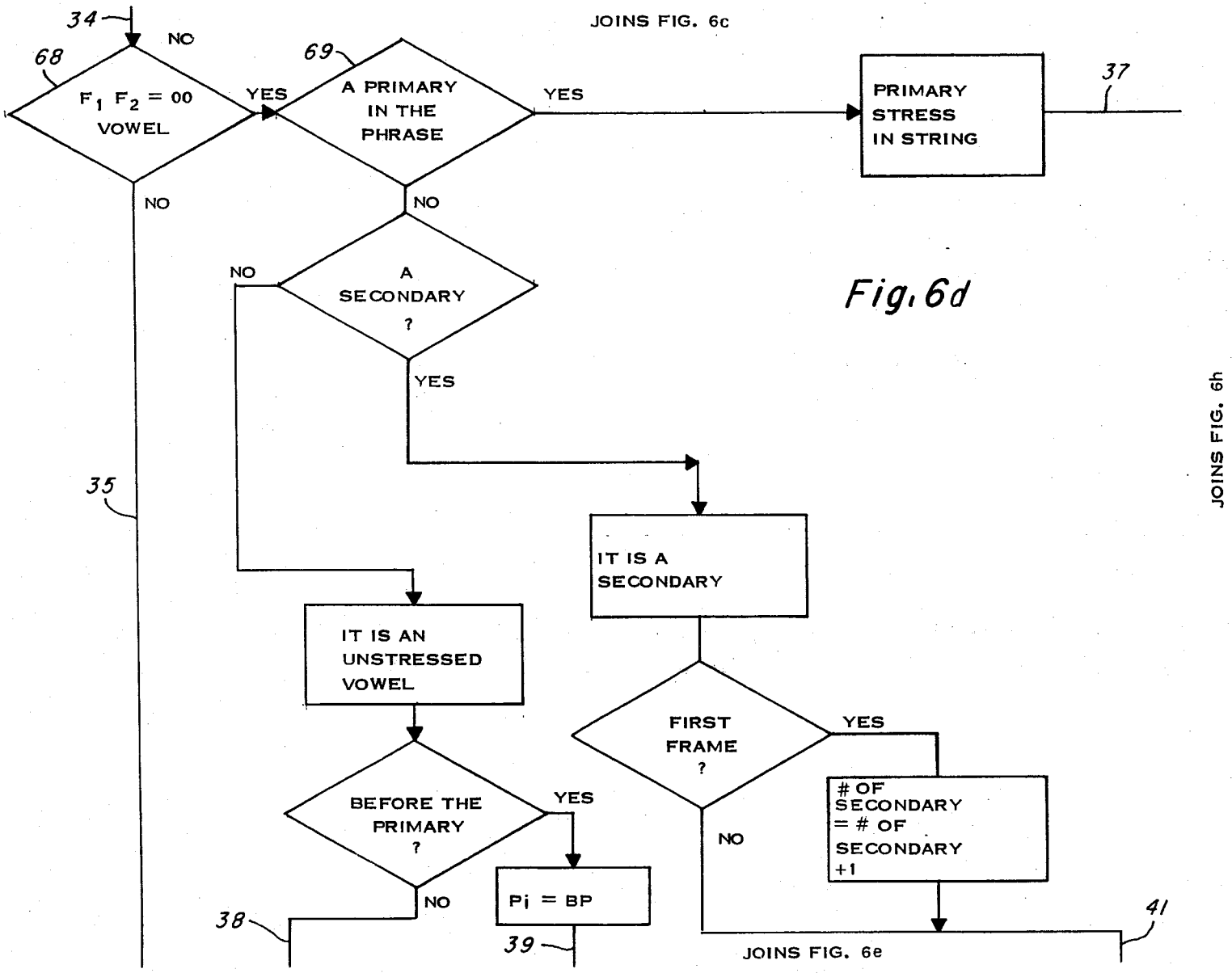
Figure 6E:
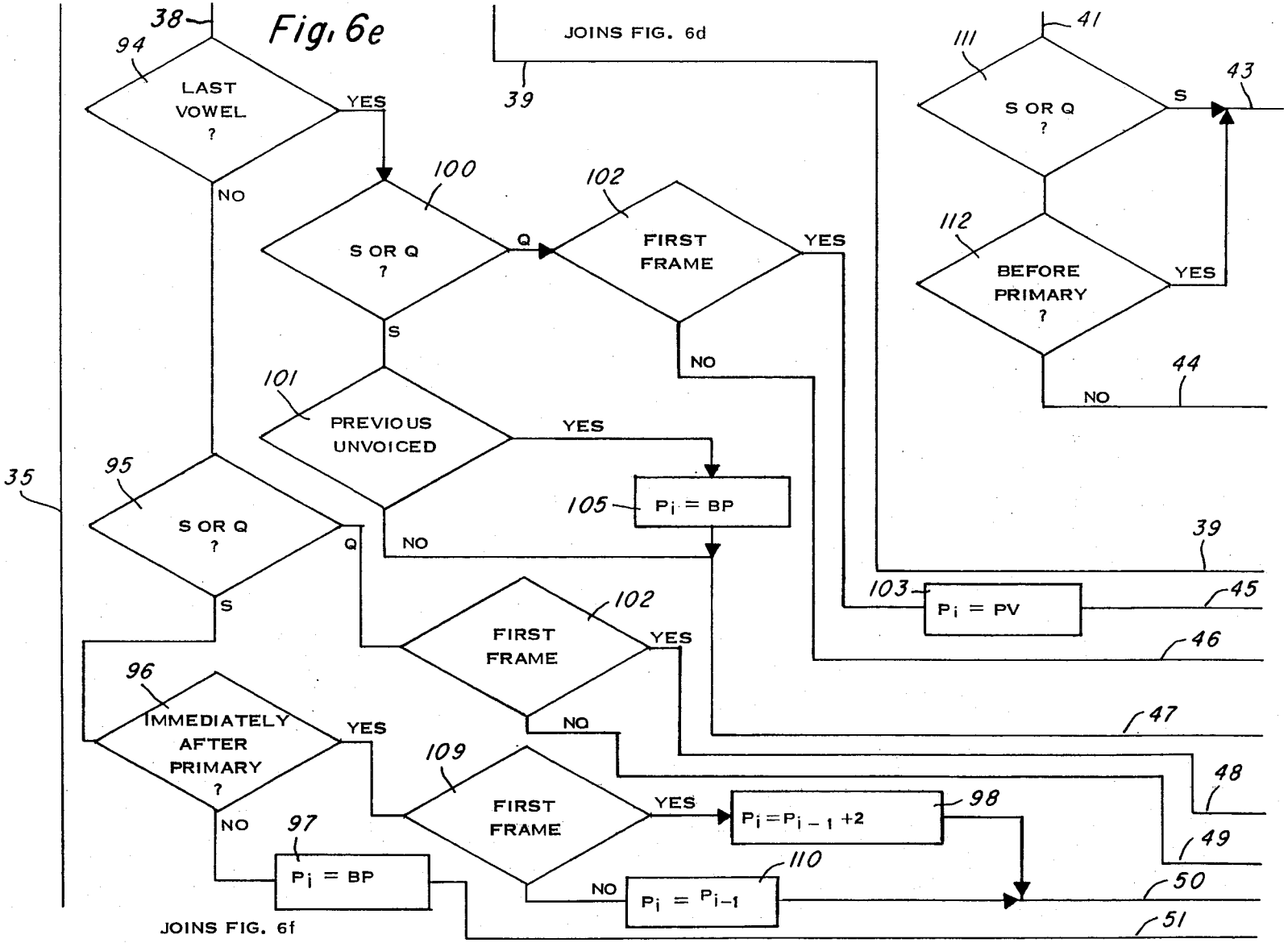
Figure 6F:
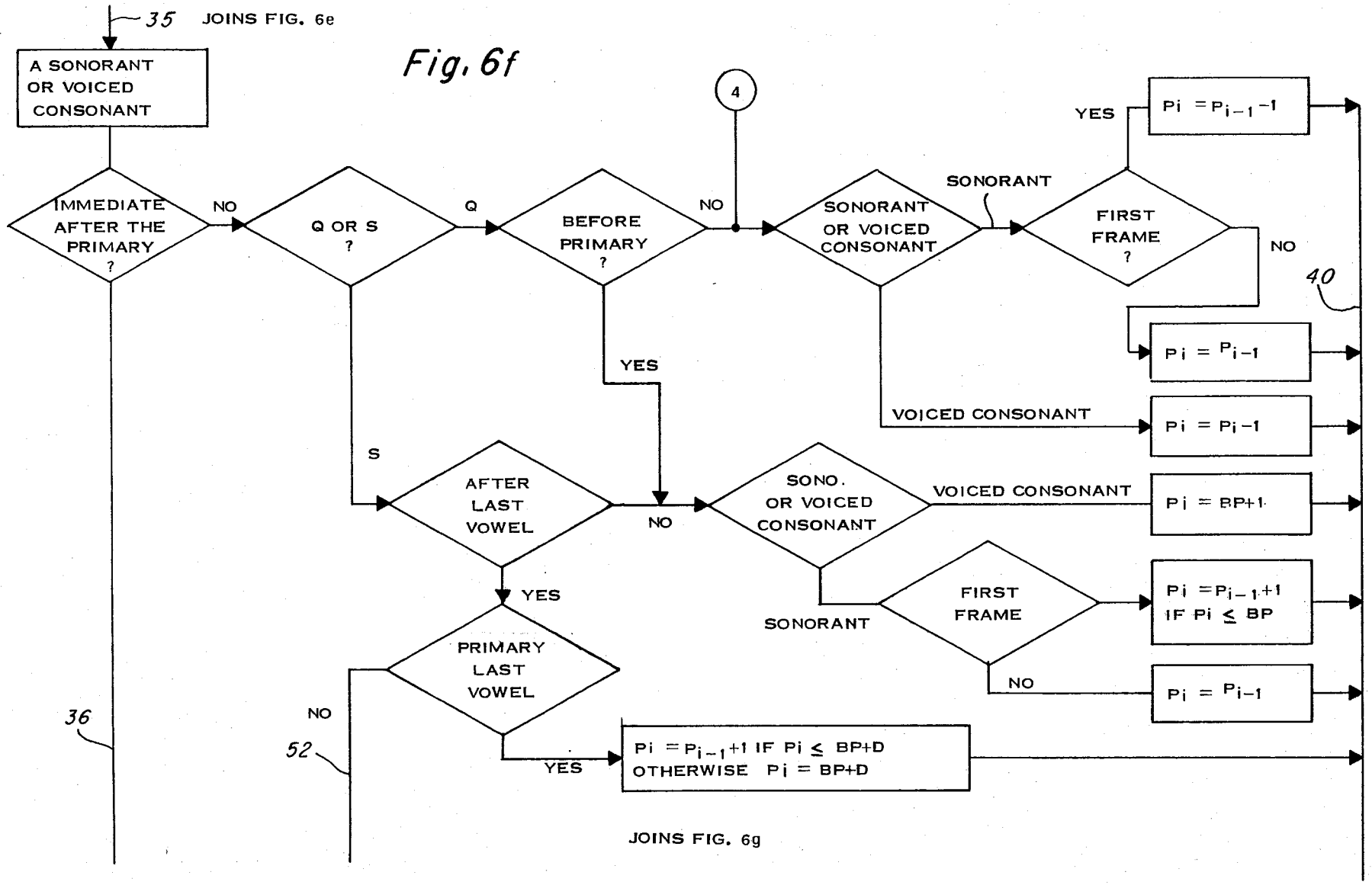
Figure 6G:
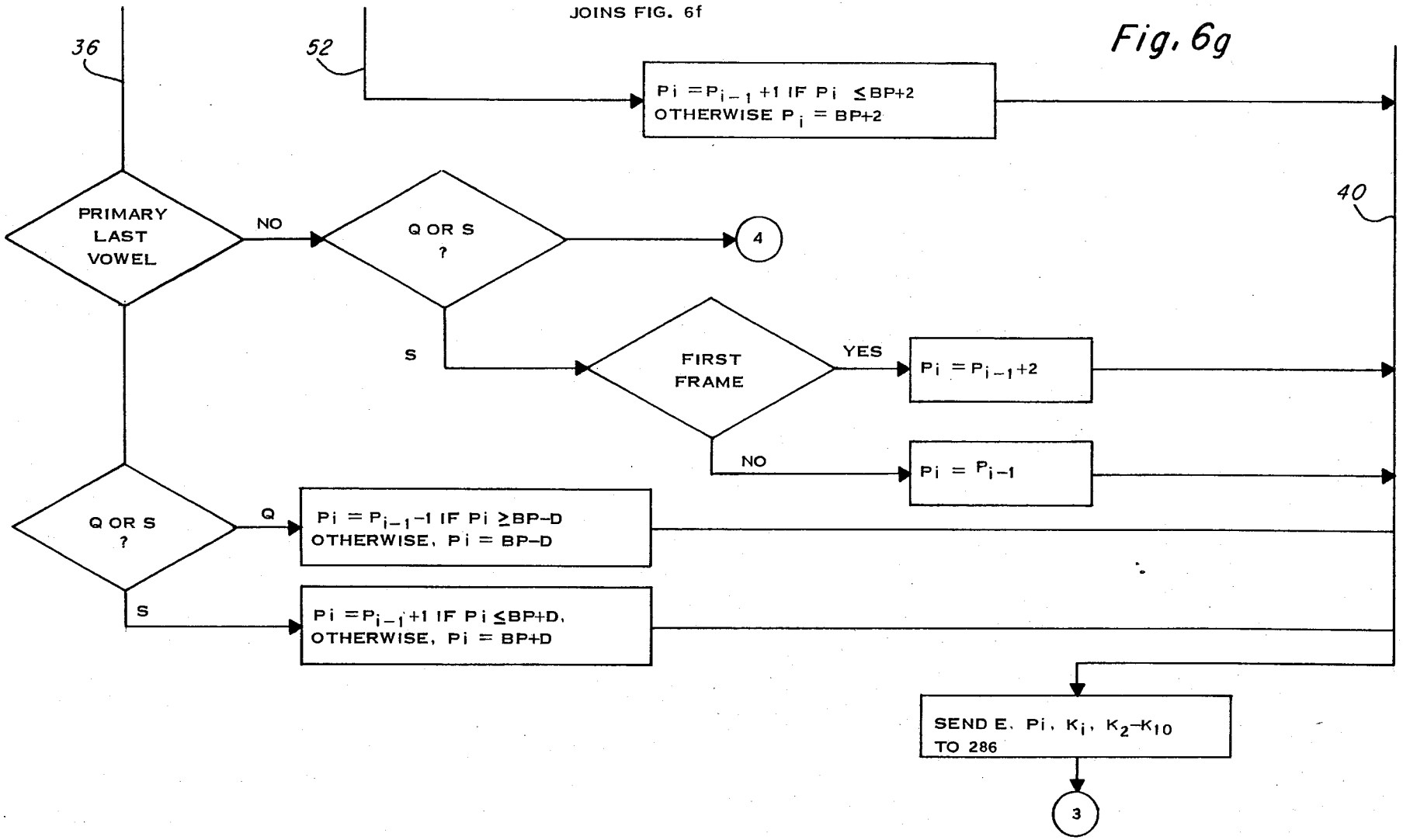

If the delta pitch≠0, then on path 34 into FIG. 6*d*, it is determined whether F1 F2=00, indicating a vowel. If the answer is "yes," then the question "a primary in the phrase" is asked. If the answer is "no" it is asked whether there is a secondary in the phrase. If the answer is "no," then the vowel is unstressed and the question is asked "is this vowel before the primary stress." If the answer is "no," then on path 38 to FIG. 6*e*, the decision is made as to whether this is the last vowel. If the answer is "no," then the decision is made as to whether it is a statement or a question type phrase. If the answer is that it is a statement, the decision is made to determine whether it is immediately after the primary stress. If the answer is "no," then the pitch is made equal to the base pitch and on path 51 to FIG. 6*i*, it is seen that path 40 returns to FIG. 6*g* where it is indicated that all parameters are sent to the 286 synthesizer 14 for reading and another frame is brought in. This particular path was chosen because of its simplicity of explanation. The multitude of remaining paths shown illustrate the great detail the selection of pitch at the required points.

Figure 6H:
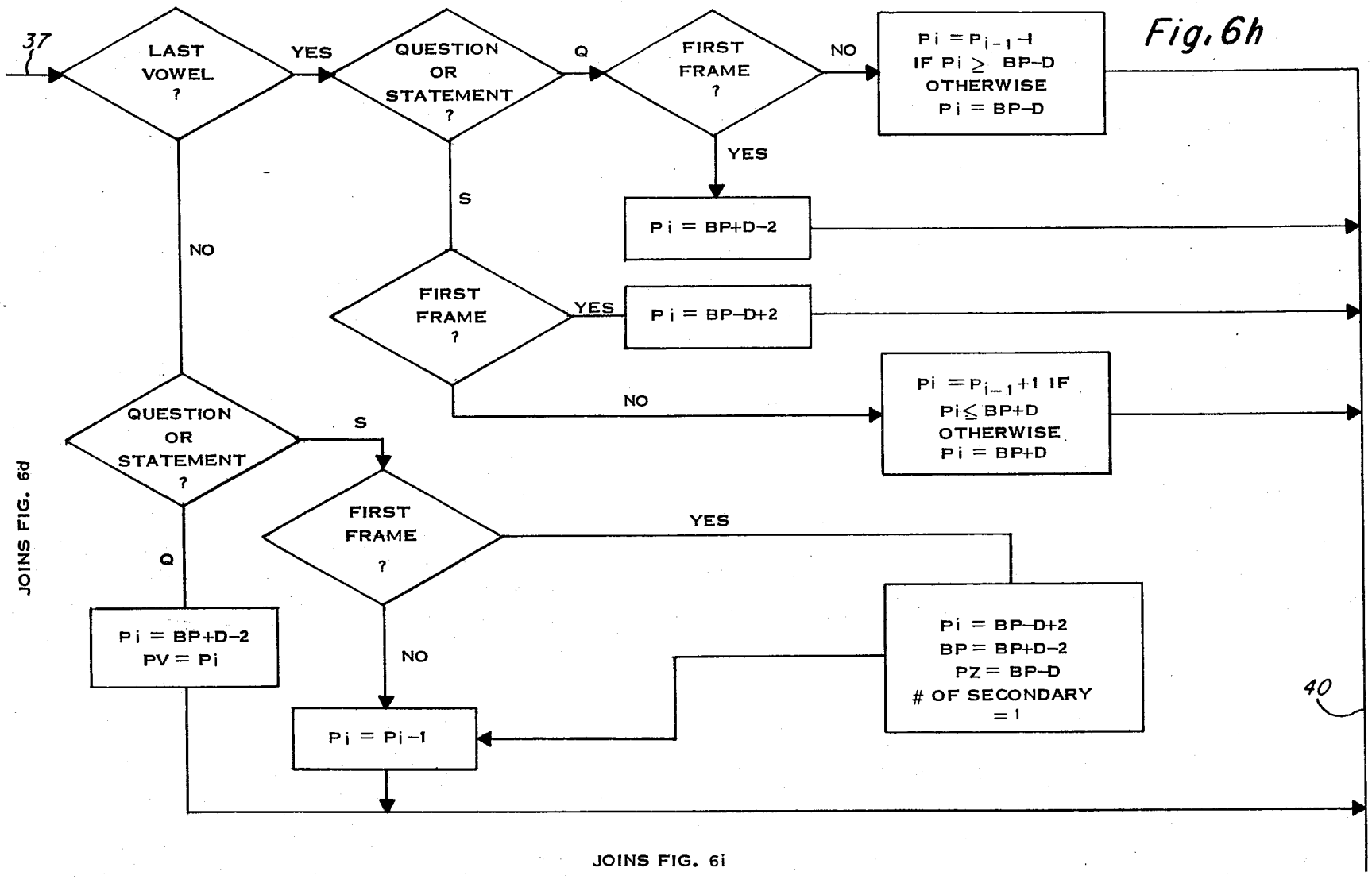
Figure 6I:
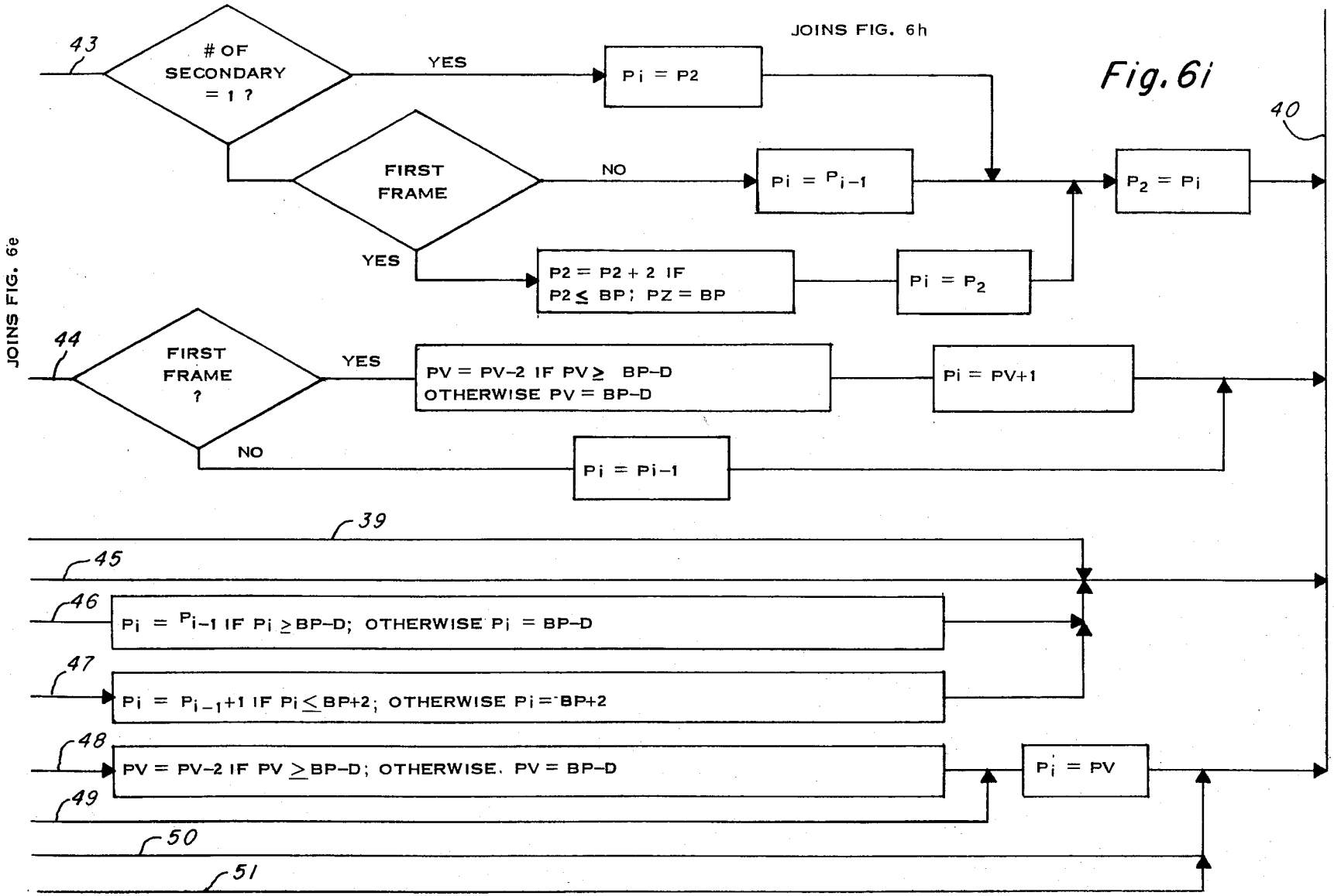

The assignment of descending or ascending base pitch is shown in FIG. 6*h*. Path 37 from FIG. 6*d* indicates that there is a primary stress in the particular string and if it is the last vowel, then it is determined whether the phrase is a question or statement. If it is a question, it is determined whether it is the first frame of the allophone. If the answer is "yes," then pitch is assigned as indicated equal to BP+D−2. If it is a statement, and it is the first frame, then pitch is assigned as BP−D+2. This assignment of pitch is set out in Section 4.6.

MODE OF OPERATION

The operation of this invention is primarily shown in FIGS. 5*a*–5*b* and 6*a*–6*i*. In broad terms, however, the speech producing system of this invention accepts allophonic code through the 420 microprocessor 11 shown in FIG. 1. The code received is related to an address in the allophone library 12. The code is sent by the 420 microprocessor 11 to 356 stringer 13 where the address is read and the allophone is brought out when handled as indicated in FIGS. 6*a*–6*i*. The basic control by the 420 microprocessor 11 in causing the action by the 356 stringer 13 is shown in FIGS. 5*a* and 5*b*. The 286 synthesizer 14 receives the allophone parameters from the 356 stringer 13 and forms an analog signal representative of the allophone to the speaker 15 which then provides speech-like sound.

This inventive speech producing system, in its preferred embodiment, describes an LPC synthesizer on an integrated circuit chip with LPC parameter inputs provided through allophones read from the allophonic library. It is of course contemplated that other waveform encoding types of code inputs may be used as inputs to a speech synthesizer. Also, the specific implementation shown herein is not to be considered as limiting. For example, a single computer could be used for the functions of the microprocessor, the allophone library, and the stringer of this invention without departing from its scope. The breadth and scope of this invention are limited only by the appended claims. .

What is claimed:

1. An electronic speech-producing system for receiving allophonic code signals representative of allophonic units of speech and for producing audible speech-like sounds corresponding to the allophonic code signals, said speech-producing system comprising:

allophone library means in which digital signals representative of allophone-defining speech parameters identifying the respective allophone subset variants of each of the recognized phonemes in a given spoken language as modified by the speech environment in which the particular phoneme occurs are stored, said allophone library means being responsive to the allophonic code signals for providing digital signals representative of the particular allophone-defining speech parameters corresponding to said allophonic code signals;

means operably associated with said allophone library means for concatenating the digital signals in a manner designating stress and intonation patterns;

speech synthesizing means operably coupled to said concatenating means for receiving the digital signals representative of allophone-defining speech parameters and providing analog signals representative of synthesized speech corresponding to the digital signals received thereby; and audio output means operably connected to the output of said speech synthesizer means for receiving said analog signals representative of synthesized speech therefrom to produce audible synthesized speech-like sounds having stress and intonation incorporated therein.

2. An electronic speech-producing system as set forth in claim 1, wherein said allophone library means comprises a read-only-memory having a plurality of storage addresses respectively corresponding to allophonic code signals, the data contents at each of said storage addresses of said allophone library means including digital signals representative of allophone-defining speech parameters.

3. An electronic speech-producing system as set forth in claim 2, further including smoothing means operably associated with said speech synthesizing means for selectively smoothing the transition between the digital signals representative of allophone-defining speech parameters identifying adjacent allophones.

4. An electronic speech-producing system as set forth in claim 3, wherein said concatenating means further includes means for designating a pitch parameter for the allophone-defining speech parameters as represented by the digital signals from said allophone library means corresponding to said allophonic code signals.

5. An electronic speech-producing system as set forth in claim 4, wherein an allophone comprising a speech unit is defined by a plurality of speech data frames each of which comprises allophone-defining speech parameters, and wherein a base pitch parameter is designated by said pitch parameter-designating means for each speech data frame.

6. An electronic speech-producing system as set forth in claim 5, wherein the base pitch parameter as designated by said pitch parameter-designating means is modified by an operator-inserted coded primary or secondary stress signal.

7. An electronic speech-producing system as set forth in claim 4, wherein the allophonic code signals include stress code data therein identifying portions of the allophonic code signals corresponding to syllables of the speech to be spoken which are to be stressed such that the digital signals provided by said allophone library means in response to said allophonic code signals are representative of allophone-defining speech parameters including the syllable stress as identified by the stress code data, and said pitch parameter-designating means being responsive to said digital signals provided by said allophone library means for designating a base pitch parameter for the allophone-defining speech parameters as modified by the syllable stress included therein.

8. An electronic speech-producing system as set forth in claim 7, wherein the base pitch parameter indicative of the base pitch in the speech unit to be spoken comprises a descending gradient for a statement and an ascending gradient for a question.

9. An electronic speech-producing system as set forth in claim 7, wherein the stress and intonation patterns designated by said concatenating means are dependent upon gradient pitch control of the stressed syllables preceding the primary stress of the phrase of speech as represented by the digital allophonic code signals having stress code data therein, and the gradient pitch control being provided by said pitch parameter-designating means.

10. An electronic speech-producing system as set forth in claim 9, wherein said pitch parameter-designating means includes means for designating a delta pitch parameter for limiting the amplitude of the primary or secondary stress modification.

11. An electronic speech-producing system as set forth in claim 1, wherein an allophone is defined by a plurality of speech data frames each of which comprises allophone-defining speech parameters, and each of said speech data frames including a signal indicative of whether or not the frame is the end of the allophone.

12. An electronic speech-producing system as set forth in claim 11, further comprising smoothing means operably associated with said concatenating means for selectively smoothing the transition between the digital signals representative of allophone-defining speech parameters identifying adjacent allophones, said smoothing means including means for selectively inserting an additional speech data frame having allophone-defining speech parameters after the last of the plurality of speech data frames defining a respective allophone.

13. An electronic speech-producing system as set forth in claim 12, wherein said smoothing means further includes means for identifying the nature of the current allophone and the allophone subsequent thereto as being voiced or unvoiced speech units, or stop.

14. An electronic speech-producing system as set forh in claim 13, wherein said means for selectively inserting an additional speech data frame is activated when no stop is present, and the current allophone and the allophone subsequent thereto as determined by said identifying means are both voiced or both unvoiced speech units.

15. An electronic speech-producing system for receiving allophonic code signals representative of allophonic units of speech and for producing audible speech-like sounds corresponding to the allophonic code signals, said speech-producing system comprising:

allophone library means in which digital signals representative of allophone-defining speech parameters identifying the respective allophone subset variants of each of the recognized phonemes in a given spoken language as modified by the speech environment in which the particular phoneme occurs are stored, said allophone library means being responsive to the allophonic code signals for providing digital signals representative of the particular allophone-defining speech parameters corresponding to said allophonic code signals;

means operably associated with said allophone library means for concatenating the digital signals in a manner designating stress and intonation patterns and including means for designating a pitch parameter for the allophone-defining speech parameters, wherein the allophone is defined by a plurality of speech data frames each of which comprises allophone-defining speech parameters and wherein a pitch parameter is designated for each speech data frame;

speech synthesizing means operably coupled to said digital signal-concatenating means for receiving the digital signals representative of allophone-defining speech parameters and providing analog signals representative of synthesized speech corresponding to the digital signals received thereby;

smoothing means operably associated with said speech synthesizing means for selectively smoothing the transition between respective allophones as defined by pluralities of speech data frames; and audio output means operably connected to the output of said speech synthesizing means for receiving said analog signals representative of synthesized speech therefrom to produce audible synthesized speech-like sounds having stress and intonation incorporated therein.

16. An electronic speech-producing system as set forth in claim 15, wherein said allophone library means comprises a read-only-memory having a plurality of storage addresses respectively corresponding to allophonic code signals, the data contents at each of said storage addresses of said allophone library means including digital signals representative of allophone-defining speech parameters.

17. An electronic speech-producing system for receiving allophonic code signals representative of allophone speech units and for producing audible speech-like sounds corresponding to the allophonic code signals, said system comprising:

allophone library means in which digital signals representative of allophone-defining speech parameters identifying the respective allophone subset variants of each of the recognized phonemes in a given spoken language as modified by the speech environment in which the particular phoneme occurs are stored, said allophone library means being responsive to said allophonic code signals for providing digital signals representative of allophone-defining speech parameters corresponding to said allophonic code signals;

means operably coupled to said allophone library means for concatenating said digital signals provided thereby in a manner designating stress and intonation patterns with respect thereto;

semiconductor integrated circuit speech synthesizing means operably associated with said concatenating means for receiving said digital signals representative of allophone-defining speech parameters and providing analog signals representative of synthesized speech corresponding to said digital signals;

and audio output means coupled to the output of said semiconductor integrated circuit speech synthesizing means for receiving said analog signals representative of synthesized speech therefrom to produce audible synthesized speech-like sounds with stress and intonation incorporated therein.

18. An electronic speech-producing system as set forth in claim 17, wherein said semiconductor integrated circuit speech synthesizing means is a linear predictive coding speech synthesizer.

19. An electronic speech-producing system as set forth in claim 18, further comprising smoothing means operably associated with said concatenating means for selectively smoothing the transition between the digital signals representative of allophone-defining speech parameters identifying adjacent allophones.

20. An electronic speech-producing system as set forth in claim 19, wherein said allophone library means comprises a read-only-memory having a plurality of storage addresses respectively corresponding to allophonic code signals, the data contents at each of said storage addresses of said allophone library means including digital signals representative of allophone-defining speech parameters.

21. An electronic speech-producing system as set forth in claim 19, wherein said concatenating means further includes means for designating a pitch parameter for the allophone-defining speech parameters as represented by the digital signals from said allophone library means corresponding to said allophonic code signals, said pitch parameter-designating means including means for establishing a base pitch parameter as modified by an operator-inserted coded primary or secondary stress signal.

22. An electronic speech-producing system as set forth in claim 21, wherein the allophonic code signals include stress code data therein identifying portions of the allophonic code signals corresponding to syllables of the speech to be spoken which are to be stressed such that the digital signals provided by said allophone library means in response to said allophonic code signals are representative of allophone-defining speech parameters including the syllable stress as identified by the stress code date, and said pitch parameter-designating means being responsive to said digital signals provided by said allophone library means for designating a base pitch parameter for the allophone-defining speech parameters as modified by the syllable stress included therein.

23. An electronic speech-producing system as set forth in claim 22, wherein the base pitch parameter indicative of the base pitch in the speech unit to be spoken comprises a descending gradient for a statement and an ascending gradient for a question.

24. An electronic speech-producing system as set forth in claim 23, wherein the stress and intonation patterns designated by said concatenating means are dependent upon gradient pitch control of the stressed syllables preceding the primary stress of the phrase of speech as represented by the digital allophonic code signals having stress code data therein, and the gradient pitch control being provided by said pitch parameter-designating means.

25. An electronic speech-producing system as set forth in claim 24, wherein said pitch parameter-designating means includes means for designating a delta pitch parameter for limiting the amplitude of the primary or secondary stress modification.

26. An electronic speech-producing system as set forth in claim 18, wherein an allophone is defined by a plurality of speech data frames each of which comprises allophone-defining speech parameters, and each of said speech data frames including a signal indicative of whether or not the frame is the end of the allophone.

27. An electronic speech-producing system as set forth in claim 26, further comprising smoothing means operably associated with said concatenating means for selectively smoothing the transition between the digital signals representative of allophone-defining speech parameters identifying adjacent allophones, said smoothing means including means for selectively inserting an additional speech data frame having allophone-defining speech parameters after the last of the plurality of speech data frames defining a respective allophone.

28. An electronic speech-producing system as set forth in claim 27, wherein said smoothing means further includes means for identifying the nature of the current allophone and the allophone subsequent thereto as being voiced or unvoiced speech units, or stop.

29. An electronic speech-producing system as set forth in claim 28, wherein said means for selectively inserting an additional speech data frame is activated when no stop is present, and the current allophone and the allophone subsequent thereto as determined by said identifying means are both voiced or both unvoiced speech units.

30. A method for producing audible synthesized speech from digital allophonic code signals, said method comprising:

storing in a memory digital signals representative of allophone-defining speech parameters identifying the respective allophone subset variants of each of the recognized phonemes in a given spoken language as modified by the speech environment in which the particular phoneme occurs;

reading out from the memory the particular digital signals corresponding to respective allophonic code signals;

concatenating the read out digital signals;

providing digitally coded pitch parameters and intonation to the concatenated digital signals;

transmitting the concatenated digital signals to a speech synthesizer;

generating analog signals representative of synthesized speech by the speech synthesizer corresponding to the concatenated digital signals received thereby;

directing the analog signals representative of synthesized speech to an audio output means; and producing audible synthesized speech-like sounds from the audio output means corresponding to the analog signals generated by the speech synthesizer.

31. The method of claim 30, further including selectively smoothing the transition between the digital signals representative of allophone-defining speech parameters identifying adjacent allophones after the concatenation of the digital signals.

* * * * *